US006897420B2

(12) United States Patent
Hoh

(10) Patent No.: US 6,897,420 B2
(45) Date of Patent: May 24, 2005

(54) COOKER HAVING AIR CLEANING UNIT

(75) Inventor: Jung-Eui Hoh, Suwon (KR)

(73) Assignee: Samsung Electronics Co., LTD, Suwon-si (KR)

( * ) Notice: Subject to any disclaimer, the term of this patent is extended or adjusted under 35 U.S.C. 154(b) by 0 days.

(21) Appl. No.: 10/455,374

(22) Filed: Jun. 6, 2003

(65) Prior Publication Data

US 2004/0104227 A1 Jun. 3, 2004

(30) Foreign Application Priority Data

Nov. 29, 2002 (KR) ..... 10-2002-0075157

(51) Int. Cl.[7] ..... H05B 6/64
(52) U.S. Cl. ..... 219/757; 126/21 A
(58) Field of Search ..... 219/757, 400, 219/756, 681, 683, 686, 702; 126/21 A, 21 R, 39 R, 40 R, 237 R, 273 R, 299 R; 312/296

(56) References Cited

U.S. PATENT DOCUMENTS 3,783,219 A * 1/1974 Tateda ..... 219/757
4,071,738 A * 1/1978 Jenn et al. ..... 219/400
5,886,330 A * 3/1999 Kang et al. ..... 219/757
6,197,079 B1 * 3/2001 Mori et al. ..... 55/385.3
6,420,690 B1 7/2002 Kim
6,621,057 B2 * 9/2003 Kim ..... 219/757
6,670,594 B1 * 12/2003 Jeong et al. ..... 219/757

* cited by examiner

*Primary Examiner*—Quang T Van
(74) *Attorney, Agent, or Firm*—Staas & Halsey LLP

(57) ABSTRACT

A cooker having an air cleaning unit to clean the air around the cooker. The air cleaning unit has an air sucking port provided on a top wall of a casing, and an air discharging port provided at a front of an upper wall of a cooking cavity. An air passage is defined between the air sucking port and the air discharging port. A filter unit and a blowing fan are installed in the air passage. The air sucking port is integrated into a cover that hooks onto an edge of an opening that is formed on the top wall of the casing. A duct body defining the air passage is mounted on the upper wall of the cooking cavity. Guide grooves are provided at both sides of the inlet port so that the filter unit is slidably and removably fitted into the guide grooves.

24 Claims, 8 Drawing Sheets

COOKER HAVING AIR CLEANING UNIT

CROSS-REFERENCE TO RELATED APPLICATIONS

This application claims the benefit of Korean Application No. 2002-75157, filed Nov. 29, 2002, in the Korean Intellectual Property Office, the disclosure of which is incorporated herein by reference.

BACKGROUND OF THE INVENTION

1. Field of the Invention

The present invention relates to cookers, and more particularly, to a cooker that is provided with an air cleaning unit of simple construction, thus easily cleaning indoor air.

2. Description of the Related Art

As is well known to those skilled in the art, cookers, such as microwave ovens and gas oven ranges, are provided in a kitchen to cook food. When food is cooked using the cookers, food odors and exhaust gases are produced, and contaminate the indoor air of a home. The conventional cookers, however, are not provided with an air cleaning unit to clean the air inside the kitchen, so food odors or gases still remain in the kitchen even when cooking is completed.

Typically, an exhaust duct is installed in a kitchen to discharge food odors and exhaust gases produced while cooking. However, the food odors and exhaust gases produced while cooking food are not rapidly and completely discharged to the atmosphere using only the exhaust duct. Further, fine dust is not effectively removed from air inside a kitchen using only the exhaust duct.

Thus, food odors remain in the kitchen where the cookers are installed, thereby possibly causing an unpleasant smell and being unsanitary. Further, when food is cooked in a kitchen provided with several cookers where the air is not cleaned, the food may be covered with dust.

Today, as the outdoor environment becomes more polluted, it is possible that more outdoor contaminants enter a home. Thus, there has been increased demand for a cooker that cooks food in a sanitary manner, while functioning to clean air around the cooker.

SUMMARY OF THE INVENTION

Accordingly, it is an aspect of the present invention to provide a cooker having an air cleaning unit capable of cleaning the air around the cooker.

It is another aspect of the present invention to provide a cooker having an air cleaning unit that is designed to suck air through a vent disposed at a proper height, thus effectively removing fine dust from the air around the cooker.

It is a further aspect of the present invention to provide a cooker having an air cleaning unit in which a filter unit is easily mounted in and removed from the cooker.

Additional aspects and advantages of the invention will be set forth in part in the description which follows and, in part, will be obvious from the description, or may be learned by practice of the invention.

The foregoing and/or other aspects of the present invention are achieved by providing a cooker, including a cooking cavity opened at its front, a casing surrounding the cooking cavity to define an external appearance of the cooker, an air cleaning unit to clean indoor air, provided between an upper wall of the cooking cavity and a top wall of the casing, and an air sucking port and an air discharging port provided on an upper portion of the casing to suck air into the upper portion of the casing and discharge cleaned air from the upper portion of the casing to the atmosphere.

The air cleaning unit further includes an air passage connecting the air sucking port to the air discharging port so that the air sucking port communicates with the air discharging port, a filter unit installed in the air passage at a position adjacent to the air sucking port, and a blowing fan provided in the air passage.

The top wall of the casing is provided with an opening having a predetermined size. A cover, integrated with the air sucking port, removably covers the opening. Additionally, a duct body defining the air passage is mounted on the upper wall of the cooking cavity.

The duct body is provided with an inlet port facing the air sucking port and an outlet port facing the air discharging port. The air passage is defined between the inlet port and the outlet port.

According to one aspect, the blowing fan installed in the air passage is a cross-flow fan.

Guide grooves are provided at both sides of the inlet port to extend from an upper end to a lower end of the duct body so that the filter unit is slidably and removably fitted into the guide grooves.

According to another aspect, the guide grooves are inclined at a predetermined angle, so that the filter unit is inclinedly arranged with respect to the air sucking port and the air passage. The filter unit includes an electrical dust collecting filter to remove fine dust and a deodorizing filter to remove odors, which are integrated with each other in a multi-layered structure.

A handle is integrally provided on an upper end of the filter unit, thus allowing the filter unit to be easily and removably fitted into the guide grooves.

At least one hook is downwardly projected from a first end of the cover, and at least one hook hole is formed at a first edge of the inlet port of the duct body to receive the hook, so that the cover hooks on to the duct body.

At least one locking projection is provided on a second end of the cover opposite to the first end having the hook, and at least one locking hole is formed at a second edge of the inlet port of the duct body to receive the locking projection, so that the cover is removably mounted to the duct body by the hook and the locking projection.

An actuating projection is downwardly projected from a first end of the cover, and a micro switch is installed in the duct body at a position corresponding to the actuating projection, so that the actuating projection turns the micro switch on or off according to opening or closing of the cover, thus supplying electric power to the filter unit or shutting off the power.

Further, the air discharging port is formed on a front of an air discharging unit, which is provided between the cooking cavity and the casing, and is mounted to the duct body.

According to yet another aspect of the present invention, the filter unit is integrally provided on an inner surface of the cover to fit into the guide grooves of the duct body when the cover is mounted to the opening of the casing.

A handle is provided at an end of the cover to upwardly pull the cover. A hook downwardly projects from an inner surface of the handle, and a hook hole is formed on an edge of the inlet port of the duct body to receive the hook, whereby, when pressing the handle down, the hook is inserted into the hook hole so that the cover with the filter unit is mounted to the duct body. Conversely, when upwardly pulling the handle, the hook is removed from the hook hole so that the cover with the filter unit is removed from the duct body.

BRIEF DESCRIPTION OF THE DRAWINGS

These and/or other aspects and advantages of the invention will become apparent and more readily appreciated from the following description of the preferred embodiments, taken in conjunction with the accompanying drawings of which:

FIGS. 4A and 4B are sectional views taken along the line N—N of FIG. 3, in which FIG. 4A illustrates the state where a micro switch is turned off and FIG. 4B illustrates the state where the micro switch is turned on;

DETAILED DESCRIPTION OF THE PREFERRED EMBODIMENTS

Figure 1:
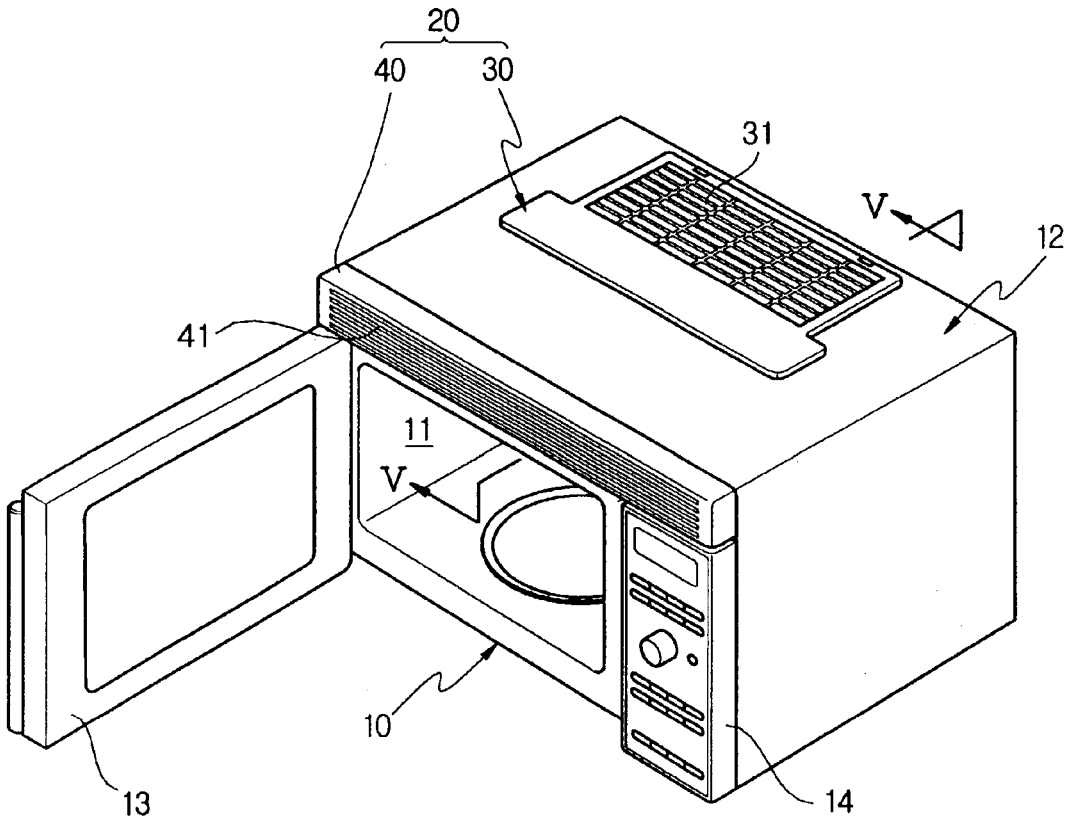
FIG. 1 is a perspective view illustrating a cooker having an air cleaning unit according to a first embodiment of the present invention.

Reference will now be made in detail to embodiments of the present invention, examples of which are illustrated in the accompanying drawings, wherein like reference numerals refer to like elements throughout.

As illustrated in FIG. 1, an air cleaning unit according to a first embodiment of the present invention is mounted to a cooker to clean air around the cooker. The air cleaning unit may be applied to various kinds of cookers, such as microwave ovens and a gas oven ranges. The present invention, however, will be described herein with reference to a microwave oven as an example of the cooker.

The cooker includes a cabinet 10 provided with a cooking cavity 11, which is opened at its front. A casing 12 surrounds the upper portion and both sides of the cabinet 10 to define an external appearance of the cooker. A door 13 is mounted to the cabinet 10 to open and close the open front of the cooking cavity 11. A control panel 14 is provided on the front of the cabinet 10 next to the door 13 of the cooking cavity 11.

According to the present invention, an air cleaning unit 20 includes a cover 30 and an air discharging unit 40. The cover 30 is mounted on the top wall of the casing 12, and is provided with an air sucking port 31. The air discharging unit 40 is mounted to a front portion of the cabinet 10 in such a way as to be positioned between the upper wall of the cooking cavity 11 and the top wall of the casing 12, and is provided with an air discharging port 41. Thus, the air cleaning unit 20 sucks indoor air into the upper portion of the casing 12 and forwardly discharges cleaned air from the upper portion of the casing 12.

According to this embodiment of the present invention, the air sucking port 31 is provided on the top wall of the casing 12 and the air discharging port 41 is provided on the upper portion of the front of the casing 12. But the air sucking port 31 and the air discharging port 41 may be provided at the upper portion of the rear wall or sidewall of the casing 12 without limiting the embodiment of the present invention.

Figure 2:
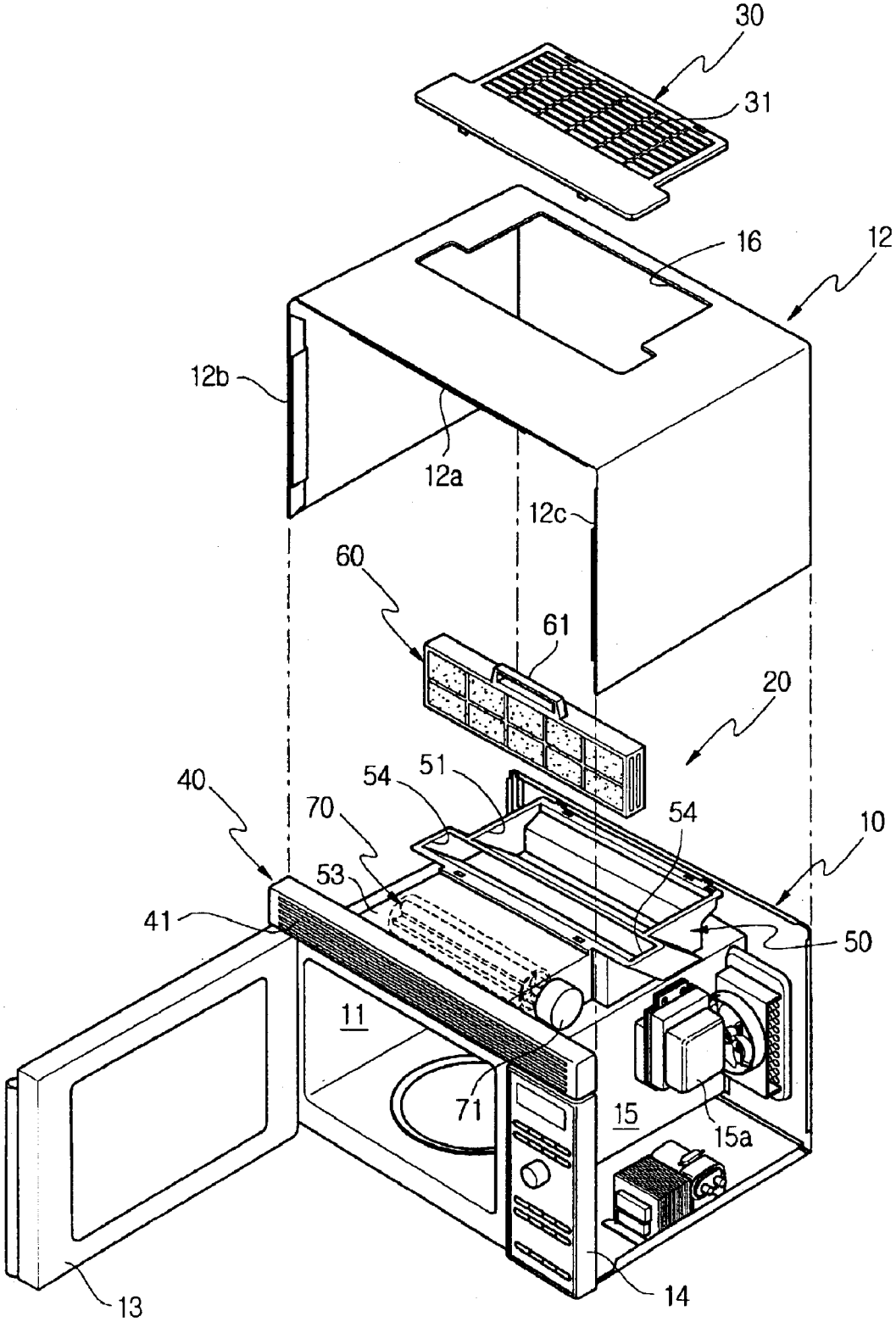
FIG. 2 is an exploded perspective view of the cooker of FIG. 1.

In FIG. 2, the casing 12 is removed from the cabinet 10 for illustrating the construction of the air cleaning unit 20 according to the first embodiment of the present invention. The casing 12 is provided with a top wall 12*a* and sidewalls 12*b* and 12*c* to cover the upper portion and both sides of the cabinet 10. The cabinet 10 is partitioned into a machine compartment 15 and a cooking cavity 11. The machine compartment 15 is defined between a partition wall of the cabinet 10 and a sidewall 12*c* of the casing 12. Several electrical devices, including a magnetron 15*a*, which generates high-frequency microwaves, are installed in the machine compartment 15.

A duct body 50 is provided between the top wall 12*a* of the casing 12 and the upper wall of the cooking cavity 11. A filter unit 60 and a blowing fan 70 are installed in the duct body 50.

The cover 30 is removably mounted to an opening 16 that is located on the top wall 12*a* of the casing 12 to have the same shape as the cover 30. The method of removing the cover 30 from the opening 16 will be described later, with reference to FIG. 3.

The duct body 50 includes an inlet port 51, an outlet port 52 (see, FIG. 3), and an air passage 53. The inlet port 51 is opened to have the same size as the opening 16 of the casing 12 at a position corresponding to the opening 16. The outlet port 52 is opened to face the air discharging unit 40. The air passage 53 connects the inlet port 51 to the outlet port 52.

Guide grooves 54 are provided at both sides of the inlet port 51 and extend from an end adjacent to the air passage 53 to an opposite end and are inclined at a predetermined angle, so that the filter unit 60 can be removably fitted into the guide grooves 54. That is, the filter unit 60, having side ends, is fitted, at the side ends, into the guide grooves 54, which are inclined at the predetermined angle so that the filter unit 60 is diagonally arranged between an upper edge and a lower edge of the inlet port 51.

As such, the filter unit 60 is inclinedly arranged at a position in the inlet port 51 of the duct body 50 to face the air sucking port 31, which is provided on the cover 30. Such an arrangement increases a sucking area of the filter unit 60, and reduces a flow resistance of air when air flows into the air passage 53.

The filter unit 60 includes an electrical dust collecting filter to remove fine dust from air, a deodorizing filter to remove food odors produced while cooking food, an anion generator to generate a large quantity of anions to provide fresh air, and a filter functioning to remove humidity or oil present in the air. These filters are integrated with each other in a multi-layered structure, thus allowing the filter unit 60 to be compact and have an excellent air cleaning effect.

A filter handle 61 is provided on an upper end of the filter unit 60. The filter unit 60 is thereby easily grasped using the filter handle 61 when it is required to slidably move the filter unit 60 along the guide grooves 54. Thus, the filter unit 60 can be easily mounted in or removed from the inlet port 51 of the duct body 50.

The blowing fan 70 is horizontally installed in the air passage 53, which is defined between the inlet port 51 and the outlet port 52. And the blowing fan 70 is rotated by a drive motor 71, which is mounted at an end of the blowing fan 70.

The blowing fan 70 may be selected from various types of fans. The blowing fan 70 comprises a cross-flow fan which does not affect a flowing direction of air, and does not need a large space for installing the fan.

Figure 3:
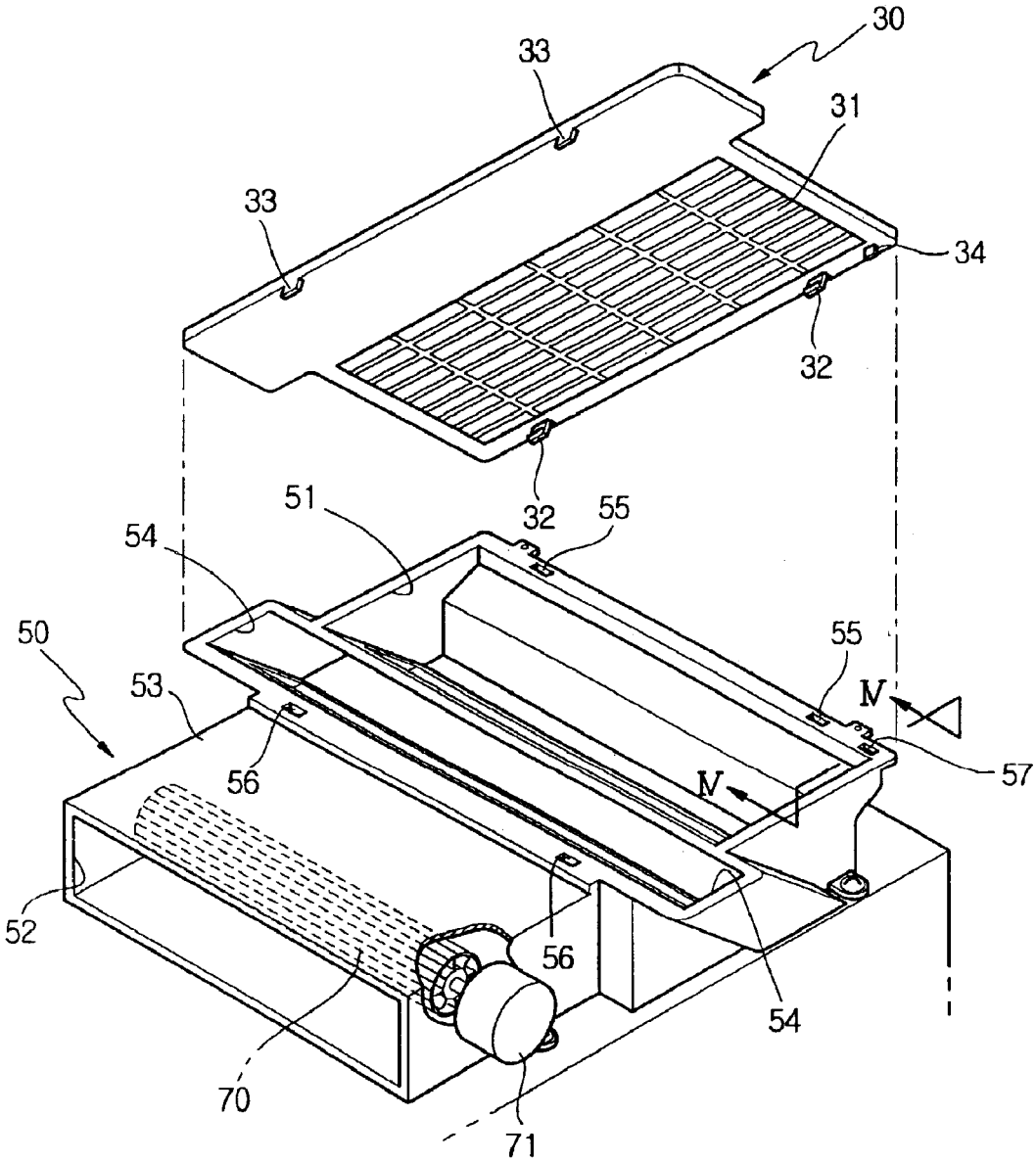
FIG. 3 is an exploded perspective view of the air cleaning unit for illustrating the structure mounting a cover to a duct body illustrated in FIG. 2.

FIG. 3 illustrates the structure mounting the cover to the inlet port of the duct body. Two hooks 32 downwardly project from a rear end of the lower surface of the cover 30. Further, two locking projections 33 are provided on the front end of the lower surface of the cover 30 to mount the cover 30 to the inlet port 51 of the duct body 50, in cooperation with the hooks 32.

When the hooks 32 are upwardly pulled with a force of a predetermined magnitude, the hooks 32 are slightly moved up. In one aspect, the hooks 32 have elasticity to return to their original positions when the force is removed. Each hook 32 is inwardly projected at its lower end. Hook holes 55 are formed at a rear edge of the inlet port 51 of the duct body 50 to receive the corresponding hooks 32, and thereby mount the hooks 32 to the duct body 50.

Thus, when the hooks 32 are fitted into the corresponding hook holes 55, the inwardly projected lower ends of the hooks 32 prevent the hooks 32 from being unexpectedly removed from the hook holes 55. When upwardly pulling the hooks 32 with a force of predetermined magnitude in such a state, the hooks 32 are removed from the hook holes 55.

Locking holes 56 are formed at the front edge of the inlet port 51 of the duct body 50 to receive the corresponding locking projections 33. Each locking projection 33 is designed such that its lower end is slightly bent outward, thus preventing the locking projections 33 fitted into the locking holes 56 from being unexpectedly removed from the locking holes 56.

When mounting the cover 30 to the inlet port 51 of the duct body 50, the locking projections 33 are fitted into the corresponding locking holes 56, and then the hooks 32 are fitted into the corresponding hook holes 55. When pressing the cover 30 with a force of predetermined magnitude, the lower ends of the hooks 32 engage with the hook holes 55, thus mounting the cover 30 to the inlet port 51 of the duct body 50. Conversely, when removing the cover 30 from the duct body 50, the hooks 32 are upwardly pulled to remove the rear end of the cover 30 from the hook holes 55. Next, the cover 30 is rearwardly pushed and then raised up to remove the locking projections 33 from the locking holes 56.

In the air cleaning unit 20 according to the first embodiment of the present invention, the hooks 32 are provided on the rear end of the cover 30 and the locking projections 33 are provided on the front end of the cover 30. But the hooks 32 may be provided on the front end of the cover 30 and the locking projections 33 may be provided on the rear end of the cover 30, and the same operational effect as the air cleaning unit 20 of the first embodiment is achieved.

An actuating projection 34 downwardly projects from the rear end of the cover 30. A through hole 57 is formed at a position of the inlet port 51 of the duct body 50 to receive the actuating projection 34 when the cover 30 is mounted to the duct body 50. The actuating projection 34 functions to prevent high voltage from being generated in the filter unit 60 when the cover 30 is opened. Such an actuating projection 34 will be described in detail with reference to FIGS. 4A and 4B.

Figure 4A:
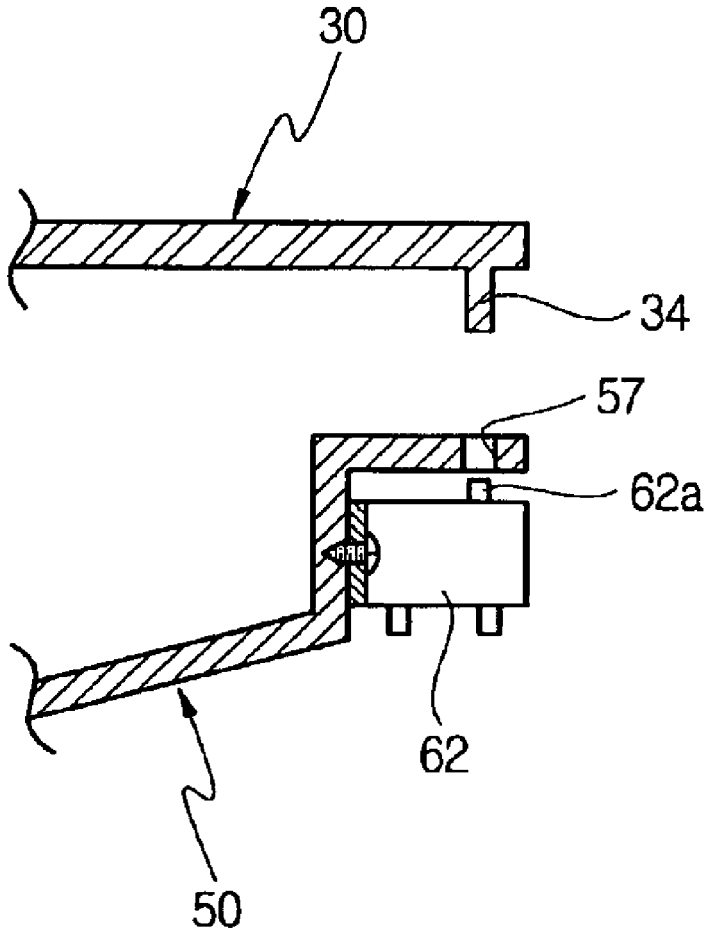
Figure 4B:
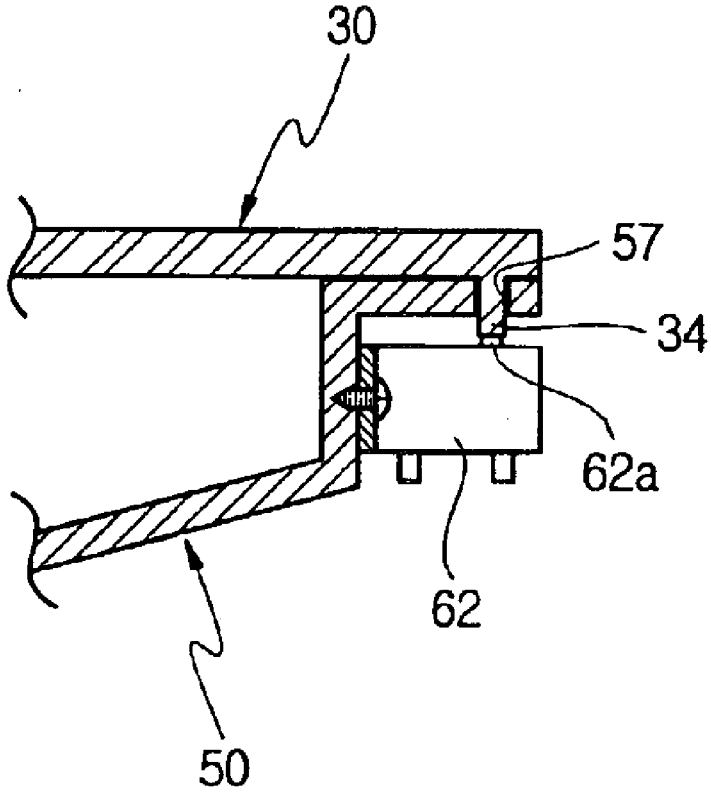

As illustrated in FIGS. 4A and 4B, a micro switch 62 is positioned under the through hole 57 (which is formed on the rear end of the inlet port 51 of the duct body 50) and is electrically connected to the filter unit 60 to selectively apply and shut off electrical power to the filter unit 60. As illustrated in FIG. 4A, when the cover 30 is removed from the duct body 50 and the actuating projection 34 is removed from the through hole 57, a button 62*a* of the micro switch 62 is upwardly moved so that the micro switch 62 is turned off. In this state, the filter unit 60 is exposed to the outside, and electrical power is not supplied to the filter unit 60. Thus, high voltage is not generated in the filter unit 60 and the filter unit 60 can be safely removed from the duct body 50, for example, when the filter unit 60 is checked or replaced.

When the cover 30 is mounted to the duct body 50 as illustrated in FIG. 4B, the actuating projection 34 passes through the through hole 57 and presses the button 62*a* of the micro switch 62, thereby turning the micro switch 62 on and supplying electrical power to the filter unit 60.

Figure 5:
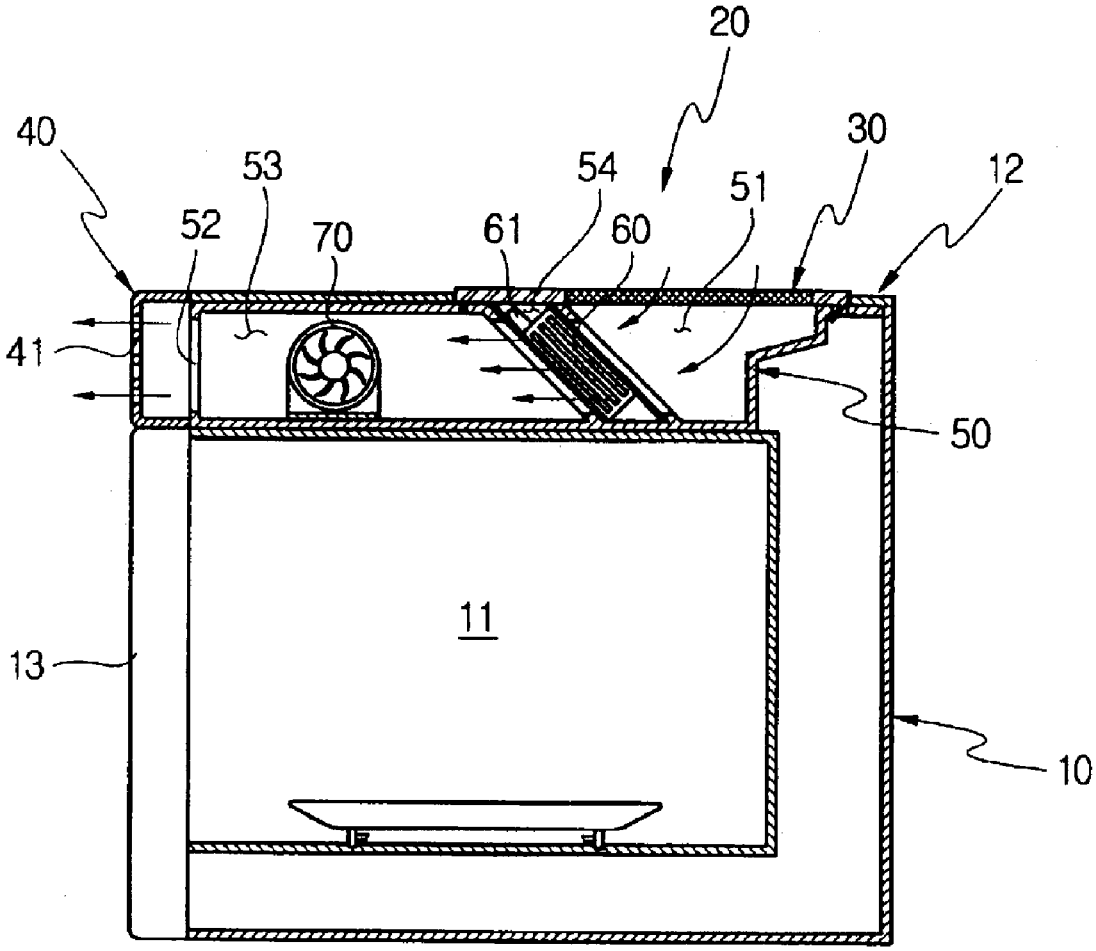
FIG. 5 is a sectional view taken along the line V—V of FIG. 1.

FIG. 5 illustrates the flow of air in the air cleaning unit according to the first embodiment of the present invention. The air cleaning unit 20 is arranged on the upper portion of the cooking cavity 11, and may be operated in conjunction with operation of the cooker. Alternatively, the air cleaning unit 20 may be independently operated to clean air around the cooker, even when the cooker is not in use.

When electrical power is applied to the filter unit 60 and the drive motor 71 of the blowing fan 70 to generate voltage in the filter unit 60 and rotate the blowing fan 70, air around the cooker flows into the inlet port 51 of the duct body 50 through the air sucking port 31 that is provided on the cover 30. The air passes through the filter unit 60, which is inclinedly arranged in the duct body 50. While passing through the filter unit 60, fine dust and odors are removed from the air and a large quantity of anions are added to the air. Subsequently, the air passes through the air passage 53 and is discharged to the atmosphere through the air discharging port 41 of the air discharging unit 40. Air around the cooker is cleaned by repeating such a process for a predetermined period of time.

Figure 6:
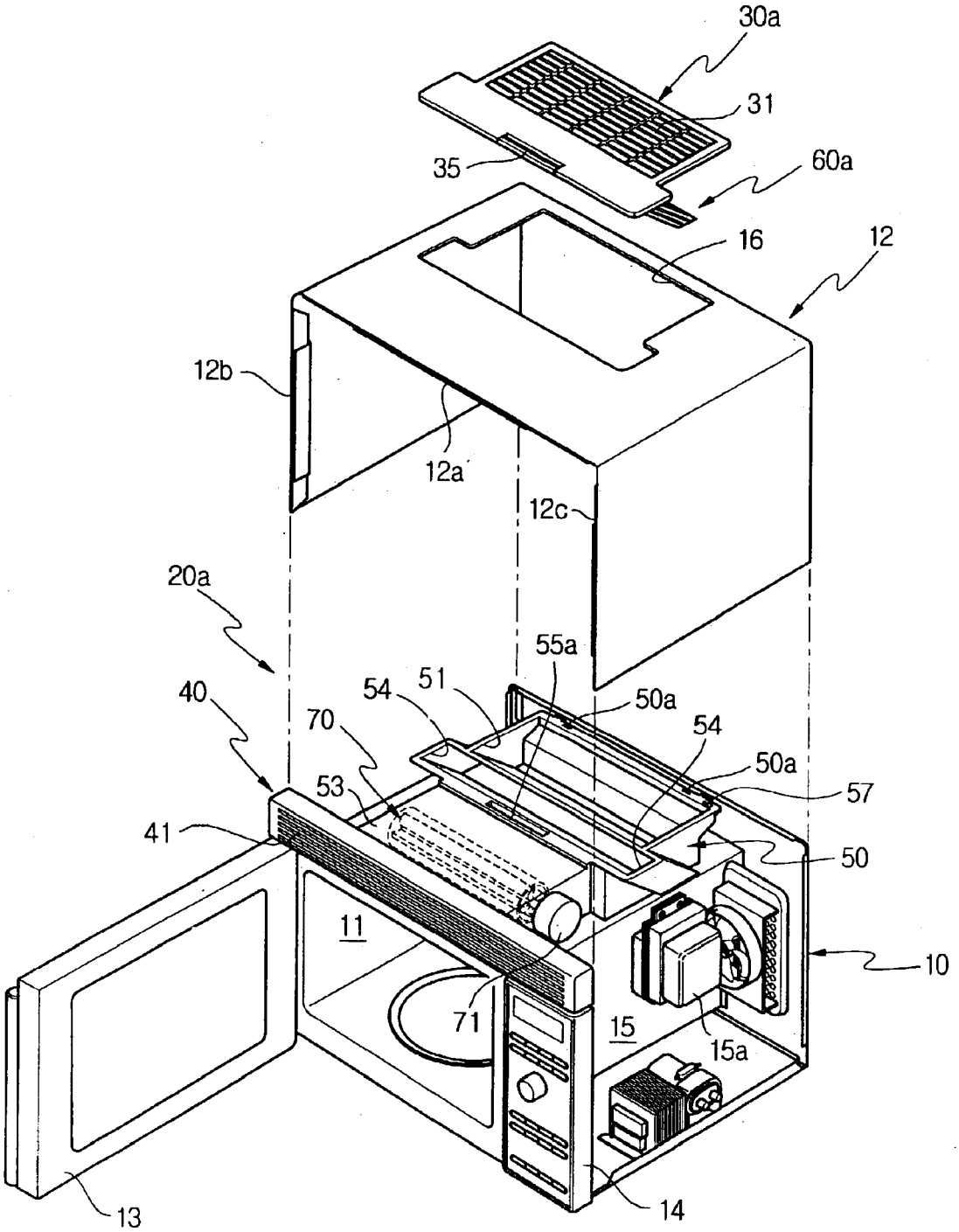
FIG. 6 is an exploded perspective view illustrating a cooker having an air cleaning unit according to a second embodiment of the present invention.
Figure 7:
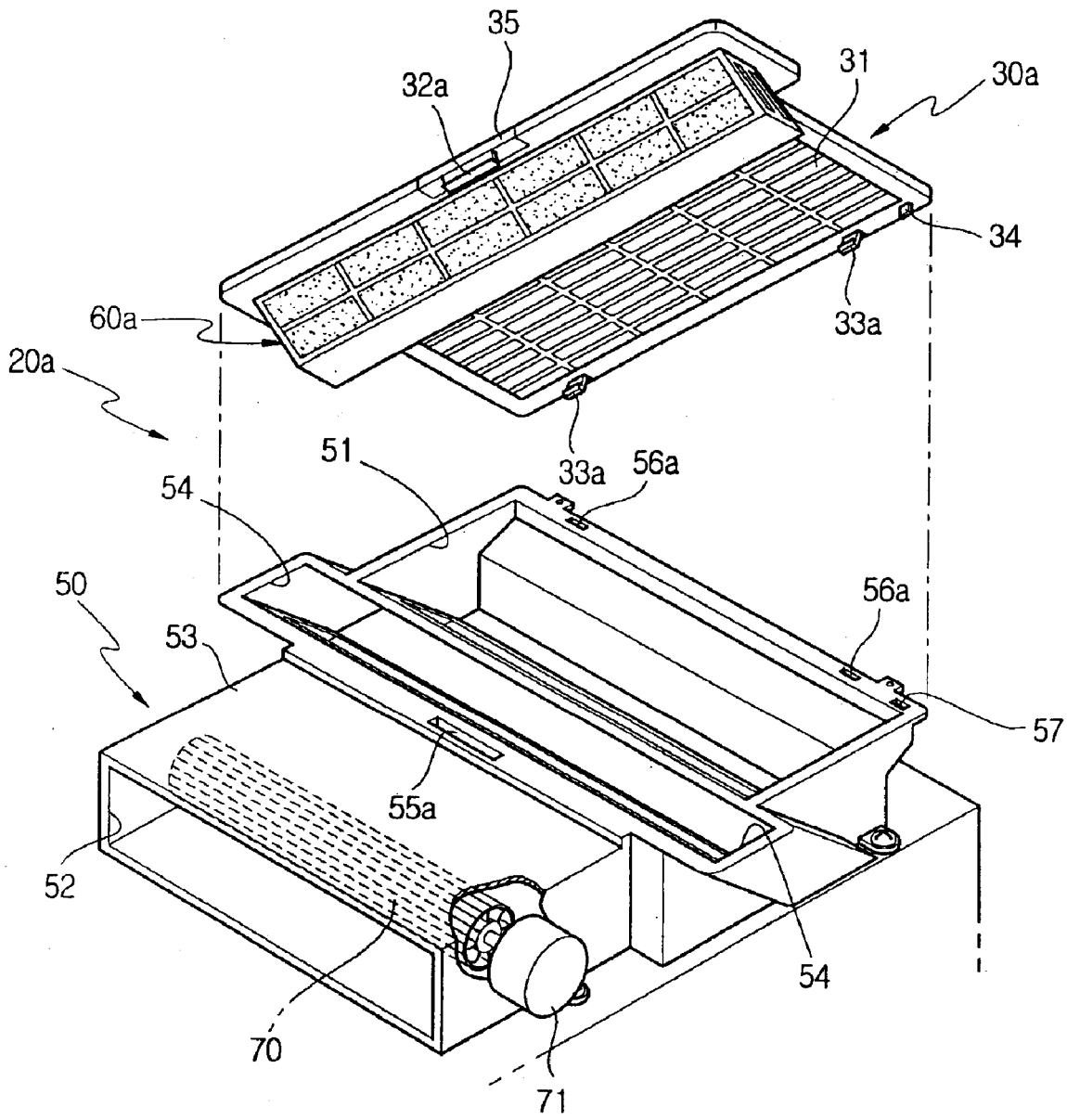
FIG. 7 is an exploded perspective view of the air cleaning unit included in the cooker of FIG. 6.

FIGS. 6 and 7 are views corresponding to FIGS. 2 and 3 respectively, but illustrating an air cleaning unit according to a second embodiment of the present invention. The air cleaning unit 20*a* has a structure similar to the air cleaning unit 20 of the first embodiment, except that a filter unit 60*a* is integrated with a cover 30*a*. Thus, only the construction of the filter unit 60*a* and the cover 30*a* will be described in the following.

The filter unit 60*a* is integrally provided on the inner surface of the cover 30*a* to be inclined toward the air sucking port 31. Since the filter unit 60*a* is integrated with the cover 30*a*, the filter unit 60*a* is fitted into or removed from the guide grooves 54 when the cover 30*a* is mounted to or removed from the duct body 50, for example, to check or clean the filter unit 60*a*. Consequently, the disassembly of the components can be easily and rapidly accomplished.

A cover handle 35 is provided at the front end of the cover 30*a*, thus allowing the cover 30*a* integrated with the filter unit 60*a* to be easily mounted to or removed from the duct body 50.

A hook 32*a* downwardly projects from the inner surface of the handle 35. Similarly, locking projections 33*a* and an actuating projection 34 downwardly project from the rear end of the cover 30*a*. Additionally, a hook hole 55*a* is formed on a front edge of the inlet port 51 of the duct body 50 to receive the hook 32*a*. And locking holes 56*a* and a through hole 57 are formed on a rear edge of the inlet port 51 of the duct body 50 to receive the locking projections 33*a* and the actuating projection 34, respectively.

To mount the cover 30*a* to the duct body 50, the locking projections 33*a* are fitted into the corresponding locking holes 56*a* and the filter unit 60*a* is aligned at both of its side ends with the guide grooves 54. A user then grasps the cover handle 35 and pushes the cover 30*a* down. This simultaneously fits the filter unit 60*a* into the guide grooves 54 and the hook 32*a* into the hook hole 55*a*, thereby mounting the cover 30*a* to the duct body 50.

To remove the cover 30*a* from the duct body 50, the cover handle 35 is upwardly pulled and the hook 32*a* is removed from the hook hole 55*a* while the locking projections 33*a* are removed from the locking holes 56*a*. The filter unit 60*a* is removed from the guide grooves 54 of the duct body 50 along with the cover 30*a*.

The process of sucking and cleaning air using the air cleaning unit 20*a* of the second embodiment is equivalent to the process using the air cleaning unit 20 of the first embodiment described with reference to FIG. 5, and therefore will not be further described.

As is apparent from the above description, the present invention provides a cooker with an air cleaning unit, that cleans the air of a room where the cooker is installed, such as a kitchen. The air cleaning unit may be used separately, or in conjunction with use of the cooker to help keep the air of the room where the cooker is installed clean.

Further, the present invention provides a cooker having an air cleaning unit that is designed to suck air into the upper portion of the cooker and discharge cleaned air from the upper portion of the cooker which is usually arranged at eye level, thus allowing people to breathe clean air and food to be cooked in a sanitary fashion.

Further, the present invention provides a cooker having an air cleaning unit that is designed such that a filter unit is easily removed from and mounted to the cooker, thereby allowing the filter unit to be easily checked and cleaned.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooker, comprising:

a cooking cavity opened at a front;

a casing surrounding the cooking cavity;

an air cleaning unit provided between an upper wall of the cooking cavity and a top wall of the casing to clean indoor air; and an air sucking port and an air discharging port provided on an upper portion of the casing to suck indoor air into the upper portion of the casing and discharge cleaned air from the upper portion of the casing to the atmosphere, wherein said air cleaning unit comprises:

an air passage defined between the air sucking port to the air discharging port so that the air sucking port communicates with the air discharging port, a filter unit installed in the air passage, and a blowing fan provided in the air passage.

2. The cooker as set forth in claim 1, wherein:

the filter unit is installed at a position adjacent to the air sucking port.

3. The cooker as set forth in claim 1, wherein said filter unit comprises:

an electrical dust collecting filter to remove dust; and a deodorizing filter to remove odors, wherein the electrical dust collecting filter and the deodorizing filter are integrated in a multi-layered structure.

4. The cooker as set forth in claim 1, wherein:

the top wall of the casing has an opening of predetermined size; and a cover having the air sucking port removably covers the opening.

5. The cooker as set forth in claim 4, further comprising:

a duct body, defining the air passage, and mounted on the upper wall of the cooking cavity.

6. The cooker as set forth in claim 5, wherein:

said duct body is provided with an inlet port facing the air sucking port and an outlet port facing the air discharging port; and said air passage is defined between the inlet port and the outlet port.

7. The cooker as set forth in claim 6, wherein:

said blowing fan installed in the air passage comprises a cross-flow fan.

8. The cooker as set forth in claim 6, further comprising:

a guide groove, provided at a side of the inlet port, and extending from an upper end to a lower end of the duct body, so that the filter unit is slidably and removably fitted into the guide groove.

9. The cooker as set forth in claim 8, wherein:

said guide groove is inclined at a predetermined angle, so that the filter unit is inclinedly arranged with respect to the air sucking port and the air passage.

10. The cooker as set forth in claim 9, further comprising:

a handle, integrally provided on an upper end of the filter unit.

11. The cooker as set forth in claim 6, further comprising:

a hook, downwardly projected from a first end of the cover; and a first edge of the inlet port of the duct body having a hook hole to receive the hook.

12. The cooker as set forth in claim 11, further comprising:

a locking projection, provided on a second end of the cover; and a locking hole, formed at a second edge of the inlet port of the duct body to receive the locking projection.

13. The cooker as set forth in claim 4, further comprising:

a micro switch, installed in the duct body, which selectively supplies power to the filter unit according to opening and closing of the cover.

14. The cooker as set forth in claim 6, further comprising:

an actuating projection, downwardly projecting from a first end of the cover; and a micro switch installed in the duct body at a position corresponding to the actuating projection;

wherein the actuating projection selectively turns the micro switch on and off according to closing and opening of the cover, thus applying and shutting off electric power to the filter unit.

15. The cooker as set forth in claim 6, further comprising:

an air discharging unit mounted to the duct body, and provided between the cooking cavity and the casing, wherein the air discharging port is formed on a front of the air discharging unit.

16. The cooker as set forth in claim 9, wherein:

said filter unit is integrally provided on an inner surface of the cover to be fitted into and removed from the guide groove of the duct body when the cover is mounted to and removed respectively from the opening of the casing.

17. The cooker as set forth in claim 16, further comprising:

a handle provided at an end of the cover.

18. The cooker as set forth in claim 17, further comprising:

a hook downwardly projecting from an inner surface of the handle, wherein an edge of the inlet port of the duct body has a hook hole to receive the hook.

19. An air cleaning system comprising:

an air cleaning unit having
- an air sucking port,
- a filter,
- a blowing fan,
- an air discharging port; and
- an air passage defined between the air sucking port and the air discharging port, so that the air sucking port communicates with the air discharging port; and a casing having a cooker, wherein
- the air cleaning unit is provided within the casing,
- the air sucking port and the air discharging port are located on at least one external face of the casing,
- the filter and the blowing fan are located in the air passage, and
- the blowing fan draws air into the sucking port and through the filter and exhausts the air through the air discharging port.

20. The air cleaning system of claim 19, wherein the filter is removable.

21. The air cleaning system of claim 19, wherein the filter comprises:

an electrical dust collecting filter to remove dust; and a deodorizing filter to remove odors, wherein the electrical dust collecting filter and the deodorizing filter are integrated in a multi-layered structure.

22. A cooker, comprising:

a cooking cavity;

a casing surrounding the cooking cavity;

an air cleaning unit provided at a first portion of the casing, between a first wall of the cooking cavity and a corresponding wall of the casing, to clean air; and an air sucking port and an air discharging port provided on the first portion of the casing, to suck air into the first portion of the casing and discharge cleaned air from the first portion of the casing to the atmosphere, wherein the air cleaning unit comprises
- an air passage defined between the air sucking port and the air discharging port,
- a filter unit installed in the air passage, and
- a blowing fan provided in the air passage.

23. The cooker as set forth in claim 22, wherein the filter unit comprises:

an electrical dust collecting filter to remove dust; and a deodorizing filter to remove odors, an anion generator to generate anions to provide fresh air; and a filter removing at least one of humidity and oil present in the air, wherein the electrical dust collecting filter, the deodorizing filter, the anion generator, and the filter are integrated in a multi-layered structure.

24. The cooker as set forth in claim 22, wherein the filter unit is removable.

* * * * *

UNITED STATES PATENT AND TRADEMARK OFFICE

CERTIFICATE OF CORRECTION

PATENT NO. : 6,897,420 B2
DATED : May 24, 2005
INVENTOR(S) : Jung-Eui Hoh

It is certified that error appears in the above-identified patent and that said Letters Patent is hereby corrected as shown below:

Column 7,
Line 53, change "comprises:" to -- comprises --.

Signed and Sealed this

Fourteenth Day of March, 2006

JON W. DUDAS
*Director of the United States Patent and Trademark Office*